US009856428B2

(12) United States Patent
Murota et al.

(10) Patent No.: US 9,856,428 B2
(45) Date of Patent: Jan. 2, 2018

(54) METHOD FOR STORING UPGRADED COAL, AND GRAIN-SIZE-CONTROLLED COAL

(71) Applicant: Kobe Steel, Ltd., Kobe-shi (JP)

(72) Inventors: Motoharu Murota, Takasago (JP); Seiichi Yamamoto, Takasago (JP); Yoichi Takahashi, Takasago (JP); Takuo Shigehisa, Takasago (JP); Naoto Watanabe, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 217 days.

(21) Appl. No.: 14/431,367

(22) PCT Filed: Sep. 18, 2013

(86) PCT No.: PCT/JP2013/075201
§ 371 (c)(1),
(2) Date: Mar. 26, 2015

(87) PCT Pub. No.: WO2014/083918
PCT Pub. Date: Jun. 5, 2014

(65) Prior Publication Data

US 2015/0240178 A1 Aug. 27, 2015

(30) Foreign Application Priority Data

Nov. 27, 2012 (JP) ..... 2012-259123

(51) Int. Cl.
*C10L 5/00* (2006.01)
*C10L 5/36* (2006.01)
(Continued)

(52) U.S. Cl.
CPC ..... *C10L 5/366* (2013.01); *C10L 5/04* (2013.01); *C10L 5/08* (2013.01); *C10L 5/361* (2013.01);
(Continued)

(58) Field of Classification Search
CPC ..... C10L 2250/06; C10L 2290/28; C10L 2290/32; C10L 5/04; C10L 5/08; C10L 5/361; C10L 5/366
(Continued)

(56) References Cited

U.S. PATENT DOCUMENTS 5,556,436 A 9/1996 Yagaki et al.
6,231,627 B1 5/2001 Reeves et al.
(Continued)

FOREIGN PATENT DOCUMENTS

CN 101972528 A 2/2011
JP 55-7863 * 1/1980
(Continued)

OTHER PUBLICATIONS

English Translation of JP 10259390 A.*
(Continued)

*Primary Examiner* — Latosha Hines
(74) *Attorney, Agent, or Firm* — Oblon, McClelland, Maier & Neustadt, L.L.P.

(57) ABSTRACT

A method for storing upgraded coal, which is economical and whereby it becomes possible to prevent the spontaneous ignition of piles; and grain-size-controlled coal which rarely undergoes spontaneous ignition during storage. The method for storing upgraded coal includes piling up granular coal containing upgraded coal, wherein the content of grains each having a grain size of 10 mm or less in the coal is 50 mass % or more. It is preferred that the content of grains each having a grain size of 1 mm or less is 25 mass % or more and the content of grains each having a grain size of 0.15 mm or less is 7 mass % or more in the coal.

4 Claims, 5 Drawing Sheets

(51) Int. Cl.
*C10L 5/04* (2006.01)
*C10L 5/08* (2006.01)

(52) U.S. Cl.
CPC ..... *C10L 2250/06* (2013.01); *C10L 2290/28* (2013.01); *C10L 2290/32* (2013.01)

(58) Field of Classification Search
USPC ..... 44/500
See application file for complete search history.

(56) References Cited

U.S. PATENT DOCUMENTS

| | | | | |
|---|---|---|---|---|
| 8,075,643 | B2 * | 12/2011 | Sugita | C10L 9/10 44/621 |
| 8,758,602 | B2 * | 6/2014 | Yamamoto | C10L 9/08 208/400 |
| 9,005,317 | B2 * | 4/2015 | Yamamoto | C10L 5/04 44/592 |
| 2003/0069149 | A1 | 4/2003 | Adachi et al. | |

FOREIGN PATENT DOCUMENTS

| | | | |
|---|---|---|---|
| JP | 5-230480 | | 9/1993 |
| JP | 7-233383 | | 9/1995 |
| JP | 10-259390 | | 9/1998 |
| JP | 10259390 | A * | 9/1998 |
| JP | 2000-297288 | | 10/2000 |
| JP | 2001-164254 | | 6/2001 |
| JP | 2001-303066 | A | 10/2001 |
| JP | 2005-241120 | A | 9/2005 |
| JP | 2006-77155 | | 3/2006 |

OTHER PUBLICATIONS

International Search Report and Written Opinion of the International Searching Authority dated Dec. 24, 2013, in PCT/JP2013/075201, filed Sep. 18, 2013.

Extended European Search Report dated Apr. 4, 2016 in Patent Application No. 13858836.3.

* cited by examiner

METHOD FOR STORING UPGRADED COAL, AND GRAIN-SIZE-CONTROLLED COAL

TECHNICAL FIELD

The present invention relates to a method for storing upgraded coal, and particle-size-controlled coal.

BACKGROUND ART

Coal for use in a thermal power plant or an iron mill is typically stored in a form of a pile in an outdoor yard. The coal stored in such a way may generate heat through a reaction with oxygen in air, leading to spontaneous ignition. In particular, low-grade coal is porous and high in oxidation reactivity, and therefore easily generates heat. To measure this, water is typically sprinkled to the pile to prevent the spontaneous ignition. This measure however requires periodic sprinkling. Hence, there is a demand for a method for efficiently preventing the spontaneous ignition.

Under such a circumstance, there have been developed techniques for preventing the spontaneous ignition of the coal pile, such as a technique of covering a pile surface with resin or the like (see Japanese Unexamined Patent Application Publication No. Hei5 (1993)-230480 and Japanese Unexamined Patent Application Publication No. 2000-297288), and a technique of spraying a surfactant containing a free radical scavenger or an oxygen trapping compound (see Japanese Unexamined Patent Application Publication No. 2001-164254). Each of such techniques however requires the resin, the free radical scavenger, or the like, and may cause an increase in cost.

In addition, there has been developed a method for producing upgraded coal from low-grade coal (porous coal) that is high in water content and low in calorific power (see Japanese Unexamined Patent Application Publication No. Hei7 (1995)-7-233383). In this method, first, porous coal is pulverized into particles, and then mixed with a mixed oil including a heavy oil content and a solvent oil content to produce a material slurry. Subsequently, the material slurry is preheated and heated to accelerate dehydration of the porous coal, and to allow the mixed oil to penetrate into pores of the porous coal, so that a dehydrated slurry is yielded. Subsequently, the upgraded porous coal and the mixed oil are separated from the dehydrated slurry, and then the upgraded porous coal is dried (dehydrated). The dried, upgraded porous coal is cooled and molded if desired. According to such a method, the water content of the porous coal is decreased, and the heavy oil adheres onto the inside of each pore of the porous coal, so that an upgraded coal high in calorific power is produced.

The upgraded coal produced by such a method is molded into briquettes from the viewpoint of workability including transporting operation and of suppressing dusting. When the briquettes are stored in a form of a pile, the pile is high in gas permeability since the briquettes have the same shape. Hence, when a coal having relatively high oxidation reactivity is piled, or when the pile has a great height, temperature of the pile increases in a relatively short time. For such an upgraded coal, therefore, there is a particular need for a storing technique that allows spontaneous ignition to be reduced.

CITATION LIST

Patent Literature

PTL 1: Japanese Unexamined Patent Application Publication No. Hei5 (1993)-230480

PTL 2: Japanese Unexamined Patent Application Publication No. 2000-297288

PTL 3: Japanese Unexamined Patent Application Publication No. 2001-164254

PTL 4: Japanese Unexamined Patent Application Publication No. Hei7 (1995)-233383

SUMMARY OF INVENTION

Technical Problem

An object of the invention, which has been made in light of the above-described circumstances, is to provide an economical method for storing upgraded coal, which suppresses spontaneous ignition of a pile, and provide particle-size-controlled coal reduced in spontaneous ignition during storage.

Solution to Problem

The invention, which has been made to solve the problem, is a method for storing upgraded coal, the method involving the step of piling a particulate coal containing upgraded coal, the particulate coal containing particles each having a particle diameter of 10 mm or less in an amount of 50 mass % or more.

In the method for storing upgraded coal, the particulate coal to be piled contains the relatively small particles each having a particle diameter of 10 mm or less in the amount of 50 mass % or more. When the coal having such a particle size distribution is piled, spaces are filled with the small particles, and a pile low in gas permeability is formed. According to the method for storing upgraded coal, therefore, spontaneous ignition of a pile can be economically suppressed without using a special material or the like.

The particulate coal preferably contains particles each having a particle diameter of 1 mm or less in an amount of 25 mass % or more, and particles each having a particle diameter of 0.15 mm or less in an amount of 7 mass % or more. Using the further small particles within such a range as described above allows spaces in the pile to be more effectively filled, and allows the suppressive ability of spontaneous ignition to be improved.

The particulate coal preferably contains particles each having a particle diameter of 10 mm or less in an amount of 90 mass % or less. The particulate coal, which contains particles each having a particle diameter of 10 mm or less in the amount of 90 mass % or less, is used as described above, thereby making it possible to improve workability and the like.

The method for storing the upgraded coal further involves the steps of molding a briquette out of the upgraded coal, and pulverizing the briquette, in which a pulverized product produced through the pulverizing step is preferably used as at least some of the particulate coal.

In this way, the molded briquette is pulverized into the upgraded coal (pulverized product) having a small particle diameter. It is thereby possible to easily produce a coal having a desired particle size distribution without newly providing a special apparatus or the like.

The particle-size-controlled coal of the invention contains upgraded coal, in which the content of particles each having a particle diameter of 10 mm or less is 50 to 90 mass %. The particle-size-controlled coal is a particulate coal having such a broad particle size distribution, which therefore makes it possible to form a pile suppressed in spontaneous ignition without degrading workability.

Herein, "particle diameter" refers to a value measured in accordance with the dry sieving in JIS Z 8815 (1994) Test sieving—General Requirements.

Advantageous Effects of Invention

As described hereinbefore, according to the method for storing upgraded coal of the invention, spontaneous ignition of a pile is suppressed without causing an increase in cost. The particle-size-controlled coal of the invention allows formation of a pile reduced in spontaneous ignition. Consequently, according to the particle-size-controlled coal and the method for storing upgraded coal of the invention, it is possible to improve usability of the upgraded coal produced from low-grade coal.

BRIEF DESCRIPTION OF DRAWINGS

FIG. 2-1 is a diagram illustrating measurement results of piles in comparative example 1.

FIG. 2-2 is a diagram illustrating measurement results of piles in comparative example 2.

FIG. 2-3 is a diagram illustrating measurement results of piles in comparative example 3.

FIG. 2-4 is a diagram illustrating measurement results of piles in Example 1.

FIG. 2-5 is a diagram illustrating measurement results of piles in Example 2 and comparative example 5.

FIG. 2-6 is a diagram illustrating measurement results of piles in Example 3.

FIG. 3 is a diagram illustrating particle size distribution of each type of coal in the embodiment.

DESCRIPTION OF EMBODIMENTS

Figure 1:
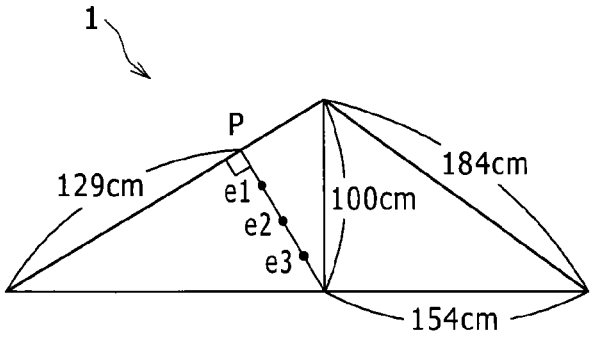
FIG. 1 is a schematic diagram illustrating a pile formed in an embodiment.

Hereinafter, the method for storing upgraded coal and the particle-size-controlled coal of the invention will be described in detail.

<Method for Storing Upgraded Coal>

The method for storing upgraded coal of the invention involves the step of (C) Piling a particulate coal containing upgraded coal, and preferably further includes the steps of, before the step (C), (A) Molding a briquette out of the upgraded coal, and (B) Pulverizing the briquette.

An example of the method for manufacturing the upgraded coal for use in that storing method is now described. The method for manufacturing the upgraded coal includes the steps of pulverizing porous coal (low-grade coal) into particles (pulverizing step), mixing the pulverized porous coal with oil to produce a material slurry (mixing step), preheating the material slurry (preheating step), heating the material slurry to produce a dehydrated slurry (heating step), separating the dehydrated slurry into upgraded porous coal and the oil (solid-liquid separation step), and drying the separated, upgraded porous coal (drying step).

(Pulverizing Step)

In the pulverizing step, the porous coal is pulverized into a particulate coal having a preferred particle diameter. Such pulverization is performed using a known pulverizer or the like. The particulate porous coal, which has been pulverized in the above way so as to be subjected to the mixing step, has any particle diameter without limitation, for example, 0.05 to 2.0 mm, preferably 0.1 to 0.5 mm.

The porous coal is a so-called low-grade coal that contains a large quantity of water and is desirably dehydrated. The porous coal has a water content of, for example, 20 to 70 mass %. Examples of such a porous coal include brown coal, lignite, and subbituminous coal (such as Samarangau coal).

(Mixing Step)

In the mixing step, the particulate porous coal is mixed with oil to produce the material slurry. The mixing step is performed using, for example, a known mixing chamber. The oil is preferably a mixed oil including a heavy oil content and a solvent oil content. Hereinafter, description is made with an exemplary case using such a mixed oil.

For example, the heavy oil content is an oil composed of a heavy content that has substantially no vapor pressure even at 400° C., or an oil containing a large amount of such a heavy content. For example, the heavy oil content includes asphalt. The solvent oil content is an oil that disperses the heavy oil content. The solvent oil content preferably includes a low-boiling oil content from the viewpoint of affinity with the heavy oil content, handling ability of a slurry including the solvent oil content, ease of penetration into the pores, and the like. Specifically, petroleum-derived oil (such as light oil, kerosene, or heavy oil) is preferred.

Using such a mixed oil including the heavy oil content and the solvent oil content results in appropriate fluidity of the mixed oil. Hence, using the mixed oil promotes penetration of the heavy oil content into the pores of the porous coal while such penetration is difficult by the heavy oil content alone. The mixed oil contains the heavy oil content in an amount of, for example, 0.25 to 15 mass %.

Any mixing ratio of the mixed oil to the porous coal may be used without limitation. For example, the amount of the heavy oil content relative to the porous coal is 0.5 to 30 mass, preferably 0.5 to 5 mass %.

(Preheating Step)

The material slurry produced through the mixing step is typically preheated prior to the heating step. While any preheating condition may be used without limitation, the material slurry is typically heated to a temperature near the boiling point of water at operation pressure.

(Heating Step)

In the heating step, the material slurry is heated to produce a dehydrated slurry. Such heating is performed using a known apparatus such as a heat exchanger and an evaporator. During this heating, dehydration of the porous coal is advanced, and the mixed oil increasingly penetrates into the pores of the porous coal. Specifically, the insides of the pores of the porous coal are covered one after another with the mixed oil containing the heavy oil content, and substantially the entire area of the openings of the pores is finally filled with the mixed oil. The heavy oil content in the mixed oil tends to be selectively absorbed to an active spot, and the attached heavy oil content is less likely to be detached; hence, the heavy oil content should be attached with priority to the solvent oil content. The inner surface of each pore is thus sealed from the external air, thereby the spontaneous ignitability can be lowered. In addition, a large amount of water is removed by the dehydration, and the mixed oil, particularly the heavy oil content, preferentially fills the insides of the pores, resulting in an increase in calorie of the porous coal as a whole.

(Solid-Liquid Separation Step)

In the solid-liquid separation step, the dehydrated slurry is separated into an upgraded porous coal and the mixed oil. Such separation is performed using a known apparatus such as a centrifuge and a filter. The mixed oil separated through this step can be reused in the mixing step.

(Drying Step)

In the drying step, the separated upgraded porous coal is dried. Such drying is performed using a known steam tube dryer, for example. The oil (solvent oil content) vaporized in the drying step can be recovered and reused in the mixing step.

The upgraded coal produced by such a method is reduced in water content in the heating step, and is high in calorific power since the heavy oil adheres onto the insides of the pores.

The steps of the method for storing upgraded coal are now described.

(A) Molding Step

In the step (A), the particulate upgraded coal (upgraded porous coal) is pressure-molded into briquettes (lamp coals). Such molding is performed using a known granulator such as a double-roll molding machine. The molding may be performed while the particulate upgraded coal is humidified, or while a binder such as starch is mixed in the coal. Such operation improves moldability.

Each briquette may have any size without limitation, for example, has a size of 1 to 100 $cm^3$. The briquette may also have any shape without limitation, for example, a sphere, a spheroid, a rectangular column, and a cylinder.

(B) Pulverizing Step

In the step (B), the briquette produced through the step (A) is pulverized to produce an upgraded coal (a pulverized product) having a small particle diameter. In this way, the molded briquette is pulverized into the upgraded coal having a small particle diameter. It is thereby possible to easily produce an upgraded coal having a desired particle size distribution without newly providing a special apparatus or the like.

Such pulverization may be performed by any method without limitation, for example, by using a pulverizer, or by simply dropping the briquette from a height. For example, the briquette is allowed to be scooped up by a wheel loader and dropped, and thereby pulverized. In this operation, for example, particle size distribution of a resultant pulverized product is easily controlled by varying a drop distance, the number of times of dropping, or the like.

The drop distance is appropriately 1 to 5 m. Dropping the briquette from such a height makes it possible to efficiently pulverize the briquette into particles having an appropriate particle size distribution. The number of times of dropping is preferably 10 to 50. Such a number of times of dropping allows the briquette to be efficiently pulverized into particles having an appropriate particle size distribution.

In the pulverizing step (B), some non-pulverized briquette may be left in the resultant pulverized product. Only some of the briquette molded in the step (A) may be subjected to the pulverizing step (B).

(C) Piling Step

In the step (C), the particulate coal, which contains the upgraded coal and has a specific particle size distribution, is piled to form a pile. Such piling is performed using a known machine such as a conveyor belt.

In the step (C), the particulate coal derived from the briquette pulverized in the step (B) can be used as the upgraded coal having the appropriate particle size distribution. The pulverized product may further contain a non-pulverized briquette, a particulate or powdered upgraded coal being unmolded, or a defective molding produced through the molding step or the like to control the particle size. Alternatively, the upgraded coal other than the pulverized product can be exclusively used to control the particle size.

In the step (C), a non-upgraded coal can be added to control the particle size of the coal as a whole. The ratio of the non-upgraded coal to the entire particulate coal to be piled is, by mass percent, preferably 30 mass % or less, and more preferably 10 mass % or less. Decreasing the usage of the non-upgraded coal prevents lowering of combustion efficiency of the coal.

The coal to be subjected to the piling step (C) contains the particles each having a particle diameter of 10 mm or less in an amount having a lower limit of 50 mass %. The relatively small particles each having a particle diameter of 10 mm or less is used in the certain amount as described above. This allows the small particles to fill spaces of the coal being piled, leading to formation of a pile having low gas permeability. According to the method for storing upgraded coal, therefore, spontaneous ignition of the pile can be economically suppressed without using a special material or the like.

The upper limit of the content of the particles each having a particle diameter of 10 mm or less is preferably 90 mass %, more preferably 70 mass %, and further preferably 65 mass %. The content of the particles each having a particle diameter of 10 mm or less is controlled to be equal to or lower than the upper limit as described above. This allows a coal having a certain size to be mixedly contained, leading to improvement in workability and the like.

The coal preferably contains the particles each having a particle diameter of 1 mm or less in an amount having a lower limit of 25 mass %. The lower limit of the content of the particles each having a particle diameter of 0.15 mm or less is preferably 7 mass %. Such further small particles are used within the above-described range of particle size distribution. This allows spaces in the pile to be further closely filled, leading to improvement in the suppressive ability of spontaneous ignition.

The upper limit of the content of the particles each having a particle diameter of 1 mm or less is preferably 40 mass %, and more preferably 35 mass %. The upper limit of the content of the particles each having a particle diameter of 0.15 mm or less is preferably 20 mass %, and more preferably 15 mass %. The upper limits of the contents of the fine particles are each controlled to be within the above-described range, thereby making it possible to suppress dusting, and improve workability and others.

During the piling, water or a surfactant solution may be sprayed onto the coal. Such operation allows dusting or ignition from the formed pile to be further reduced.

In this way, according to the method for storing upgraded coal, spontaneous ignition of the pile can be economically suppressed without using a special machine or material only by controlling the particle size distribution of the coal to be used.

<Particle-Size-Controlled Coal>

The particle-size-controlled coal of the invention contains the upgraded coal, in which the content of particles each having a particle diameter of 10 mm or less is 50 to 90 mass %.

The particle-size-controlled coal is the particulate coal for use in the method for storing upgraded coal as described above. The method for manufacturing the particle-size-controlled coal and the preferable particle diameter thereof are also similar to those of the above-described particulate coal, and description of them is omitted.

The particle-size-controlled coal is a particulate coal having such a broad particle size distribution, which therefore makes it possible to form a pile suppressed in spontaneous ignition without degrading workability.

Embodiment

Although the invention is now described more in detail with an embodiment, the invention is not limited thereto.

Examples 1 to 3 and Comparative Examples 1 to 5

There was prepared a powdered upgraded coal (UBC-P) that was produced through a step of mixing subbituminous coal (raw coal) as a material with a mixed oil including a heavy oil content and a solvent oil content, and heating such a mixture. The powdered upgraded coal was molded into a briquette-shaped upgraded coal (UBC-B, size: 47×47×28 mm). The UBC-B was dropped from a height of 3 m using a wheel loader and pulverized, so that UBC-B (pulverized) was produced. The number of times of dropping and other conditions are as described later.

The UBC-B, the UBC-B (pulverized), the UBC-P, and the raw coal were mixed in mass ratios listed in Table 1, and such mixtures were used to form coal piles about 1 m in height. Supplementary notes are shown in the lower part of Table 1.

For comparative examples 1 to 4, the UBC-B and the UBC-P were mixedly used. For comparative example 4, 15 mass parts of the UBC-P was further sprinkled onto the surface of Pile-40 as the comparative example 3. For Example 1, only the UBC-P was used. For comparative example 5, a coal pulverized according to the following procedure was used.

(Dropping UBC-B 10 times)→(Mixing the UBC-B with UBC-P)→(Dropping the mixture 10 times)

For Example 2, the raw coal was further mixed in the mixture of the comparative example 5.

For Example 3, the number of times of dropping was 30.

[Evaluation]

Figures 1, 2:
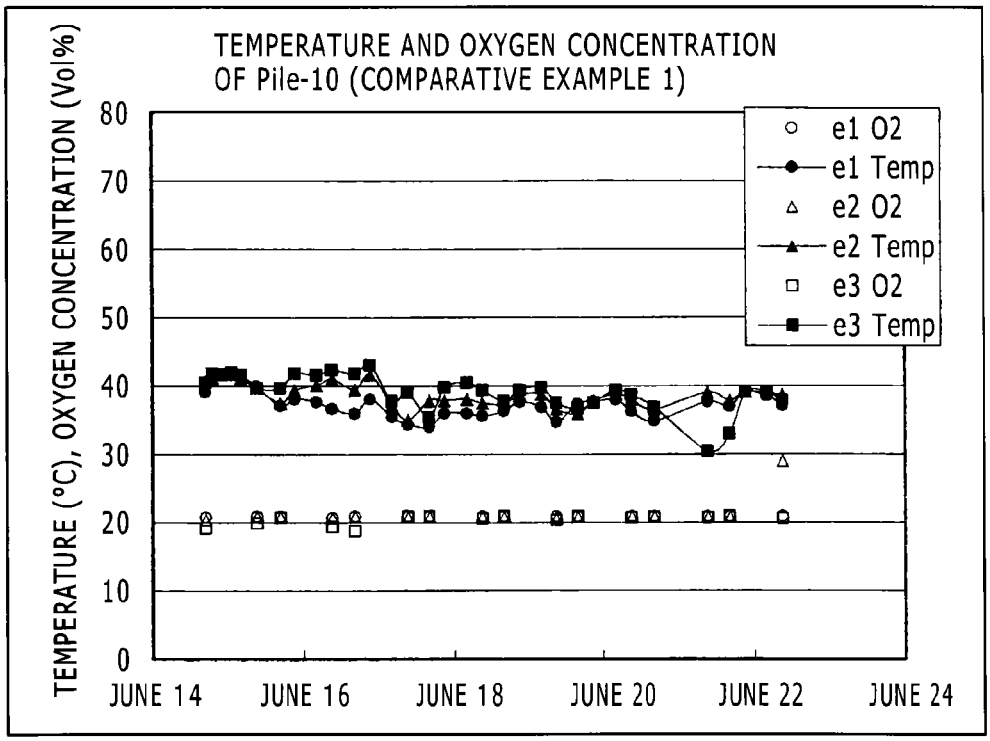
Figure 2:
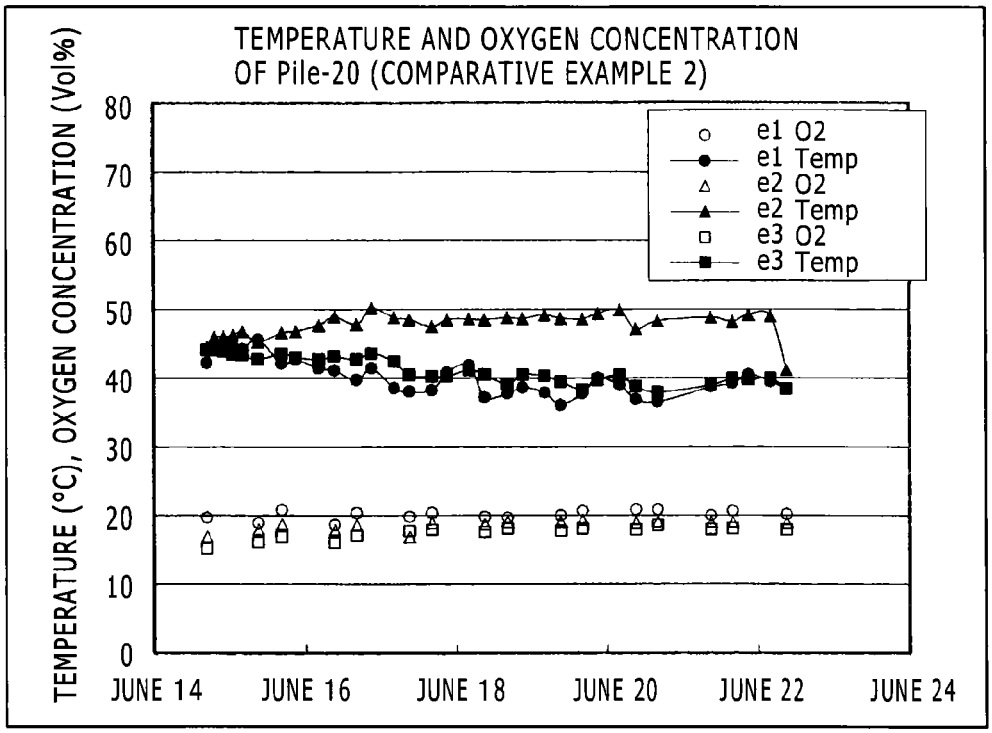

As illustrated FIG. 1, gas analysis (concentrations of $O_2$, CO, and $CO_2$) and temperature measurement were performed at measurement points e1, e2, and e3 at depths of 25 cm, 50 cm, and 75 cm, respectively, in a direction perpendicular to a slope of the pile from a position P about 129 cm away from the bottom of a pile 1. Results of them are shown in FIGS. 2-1 to 6.

Piles that were suffocated (substantially zero in oxygen concentration) were three piles of Pile-100 (Example 1, UBC-P only), Pile-40-B-New (Example 2, UBC-B (pulverized): UBC-P: raw coal=100: 38: 15), and Pile-Raw20 (Example 3, UBC-B (pulverized): raw coal=100: 19). Each suffocated pile had a substantially zero oxygen concentration in a depth range of deeper than 50 cm (while having a high oxygen concentration in a region near its surface).

Figures 2, 3:
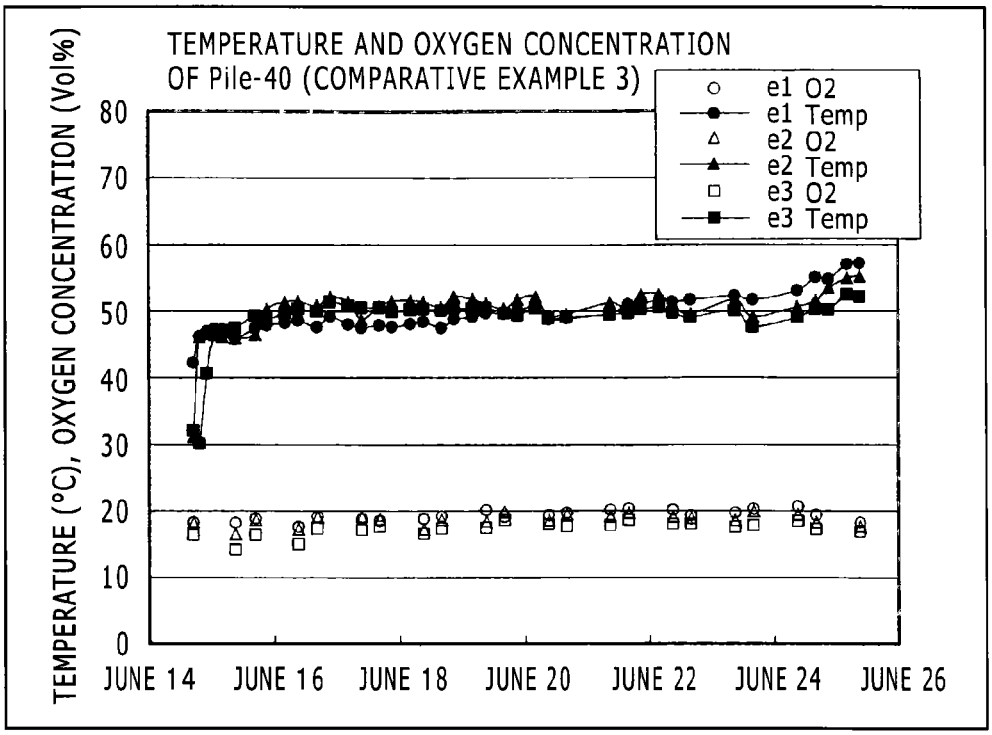
Figures 2, 3, 4:
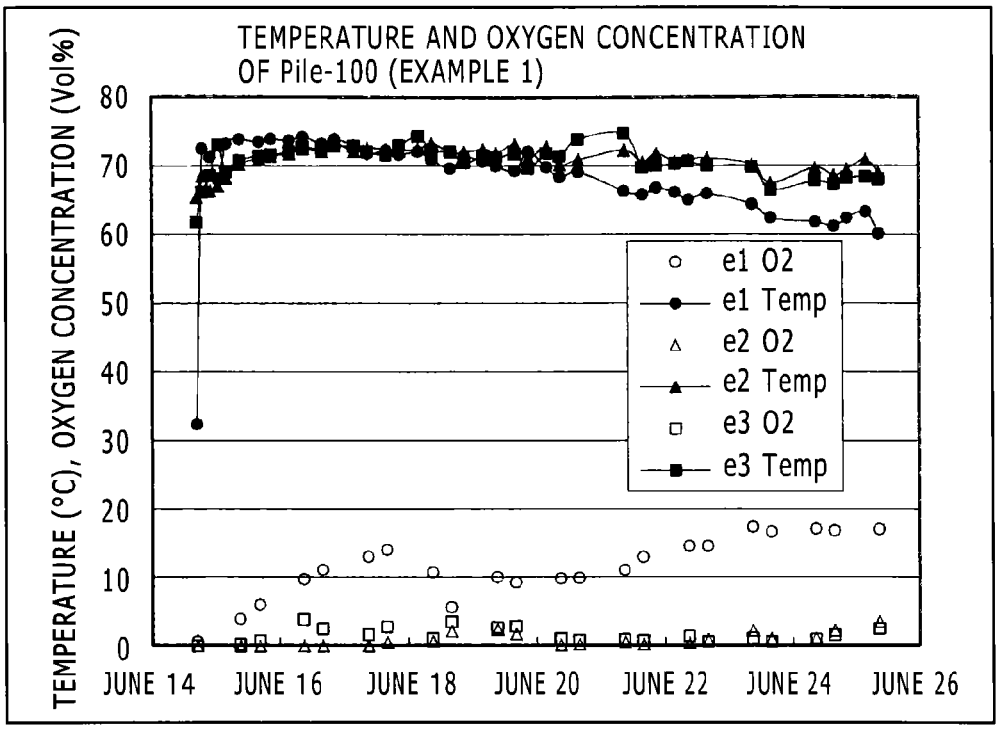
Figures 2, 3, 4, 5:
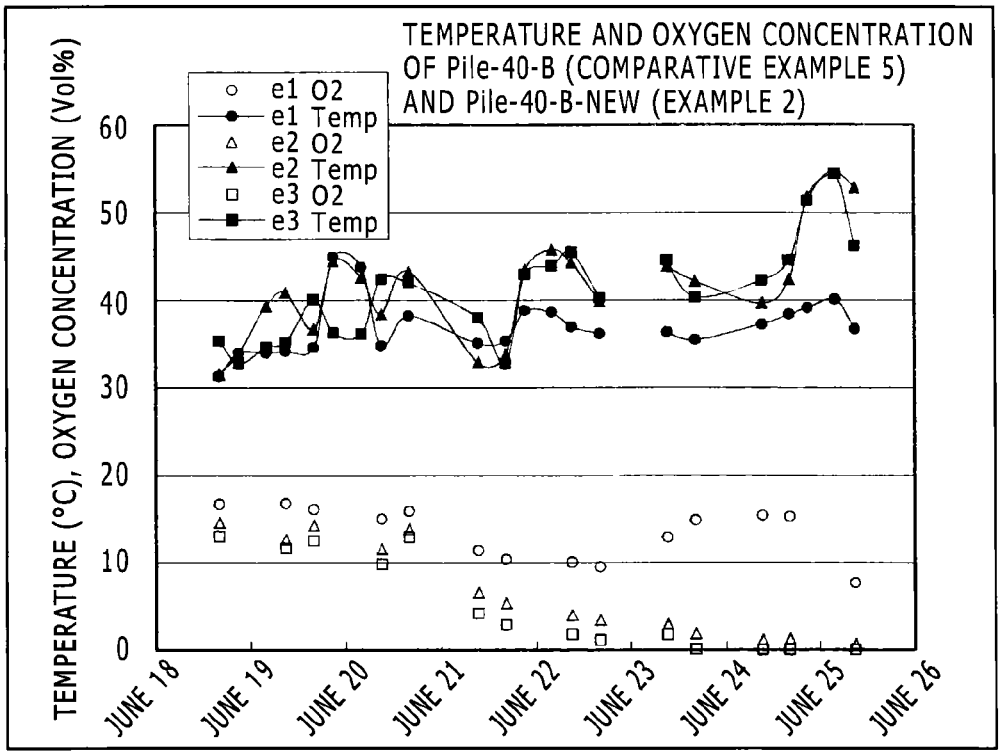
Figures 2, 3, 4, 5, 6:
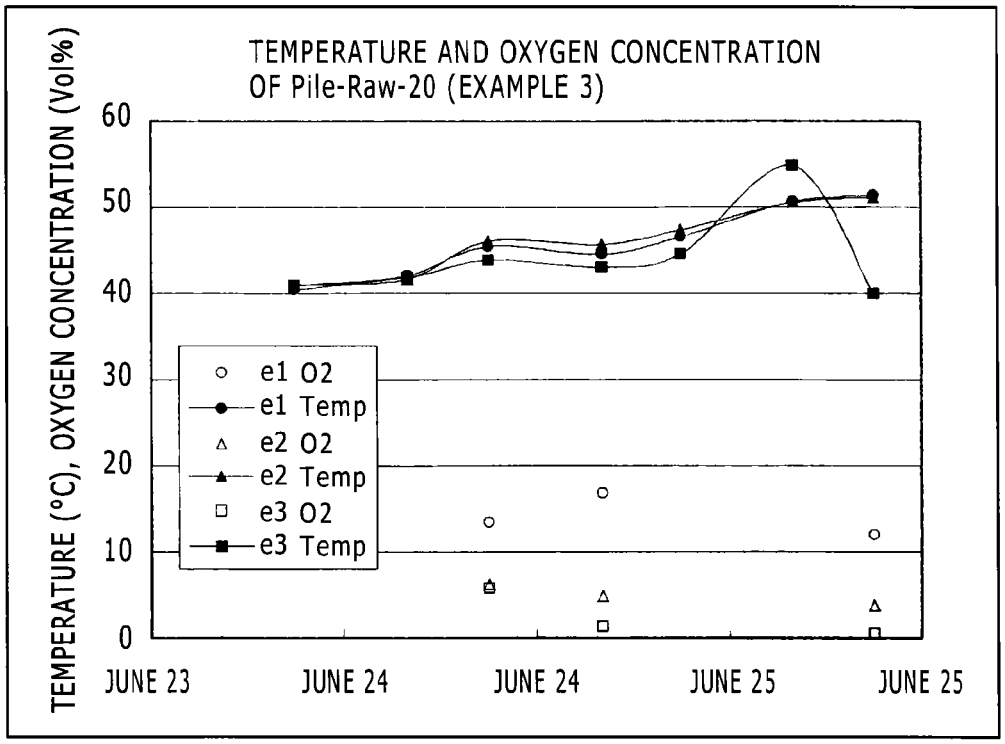
Figure 3:
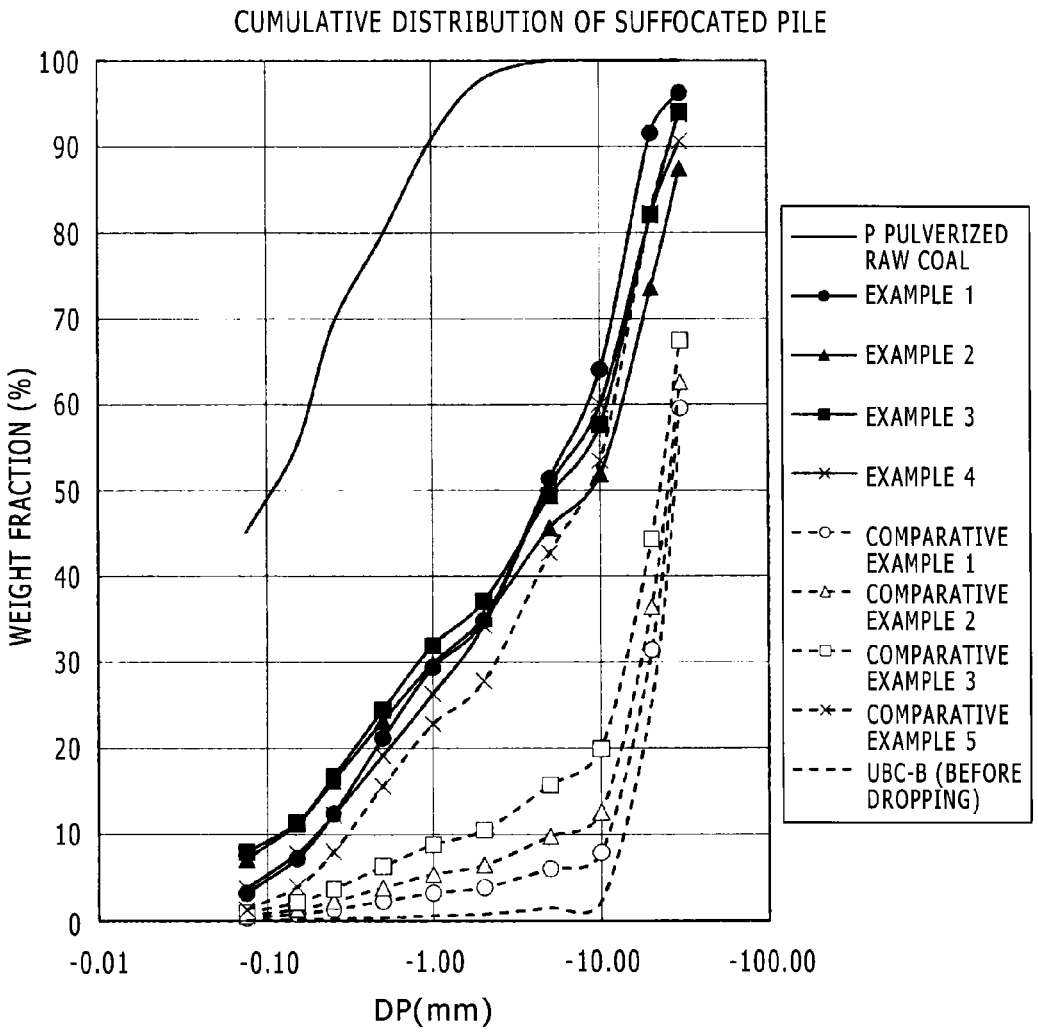

Measurement results of particle size distributions of the coals as materials of the piles (the Examples 1 to 3, the comparative examples 1 to 3 and 5, Example 4 described later, and UBC-B before dropping and the raw coal as references) are shown in FIG. 3 and Table 2. The particle size distributions are each a value obtained through analysis using a shake sieving machine from FRITSCH.

TABLE 1

| | | Comparative example 1 | Comparative example 2 | Comparative example 3 | Comparative example 4 | Example 1 | Comparative example 5 | Example 2 | Example 3 |
|---|---|---|---|---|---|---|---|---|---|
| Pile-No | | −10 | −20 | −40 | −40-New | −100 | −40-B | −40-B-New | −Raw-20 |
| Evaluation | | Not suffocated | Not suffocated | Not suffocated | Not suffocated | Suffocated | Not suffocated | Suffocated | Suffocated |
| Mixing ratio (mass ratio) | UBC-B | 100 | 100 | 100 | 100 | — | — | — | — |
| | UBC-B (pulverized) | — | — | — | — | — | 100 | 100 | 100 |
| | UBC-P | 10 | 20 | 40 | 40 + 15 | 100 | 38 | 38 | — |
| | Raw Coal | — | — | — | — | — | — | 15 | 19 |
| Real weight (kg) | UBC-B | 1920 | 1900 | 1700 | 1700 | — | — | — | — |
| | UBC-B (pulverized) | — | — | — | — | — | 1706 | 1706 | 1650 |
| | UBC-P | 189 | 383 | 680 | 680 + 250 | 2483 | 645 | 645 | — |
| | Raw coal | — | — | — | — | — | — | 250 | 320 |

TABLE 2

| | PSD Analysis (wt %) | | | | | | | | | | |
|---|---|---|---|---|---|---|---|---|---|---|---|
| | 0.075 mm | 0.15 mm | 0.25 mm | 0.5 mm | 1 mm | 2 mm | 5 mm | 10 mm | 20 mm | 30 mm | total |
| Example 1 | 3.22 | 7.19 | 12.38 | 21.14 | 29.36 | 34.82 | 51.37 | 64.06 | 91.57 | 96.24 | 100 |
| Example 2 | 7.14 | 11.22 | 16.23 | 23.17 | 29.81 | 35.09 | 45.63 | 51.88 | 73.61 | 87.46 | 100 |
| Example 3 | 7.93 | 11.35 | 16.72 | 24.43 | 31.94 | 37.10 | 49.37 | 57.67 | 82.10 | 94.02 | 100 |
| Example 4 | 3.74 | 7.76 | 12.26 | 19.13 | 26.28 | 34.25 | 50.48 | 60.04 | 81.97 | 90.63 | 100 |
| Comparative example 1 | 0.33 | 0.76 | 1.32 | 2.27 | 3.19 | 3.88 | 6.03 | 7.91 | 31.42 | 59.57 | 100 |
| Comparative example 2 | 0.57 | 1.30 | 2.24 | 3.84 | 5.37 | 6.46 | 9.81 | 12.59 | 36.43 | 62.62 | 100 |
| Comparative example 3 | 0.95 | 2.14 | 3.69 | 6.31 | 8.80 | 10.51 | 15.75 | 19.95 | 44.31 | 67.43 | 100 |
| Comparative example 5 | 1.27 | 3.93 | 7.99 | 15.60 | 22.78 | 27.78 | 42.71 | 53.45 | 82.25 | 93.80 | 100 |
| UBC-B (before dropping) | 0.04 | 0.12 | 0.22 | 0.38 | 0.58 | 0.78 | 1.50 | 2.30 | 25.40 | 55.90 | 100 |
| P pulverized raw coal | 45.11 | 55.00 | 69.20 | 79.65 | 90.86 | 97.79 | 100.00 | 100.00 | 100.00 | 100.00 | 100 |

FIG. 3 shows that the proportion of the particles each having a particle diameter of 10 mm or less is high, 50 or more mass %, in the particle size distribution of the coal of each of the Examples 1 to 3 succeeded in suffocation of the pile.

Example 4

The UBC-P was controllably mixed with another type of coal into a particle size distribution of the Example 4 shown in FIG. 3 and Table 2. Such a mixture was used to form a pile that was then subjected to gas analysis as with the Example 1 and others, so that the pile was determined to be suffocated.

INDUSTRIAL APPLICABILITY

As described hereinbefore, the method for storing upgraded coal of the invention can be economically suppressed in spontaneous ignition of the pile, and can be widely used in a thermal power plant, an iron mill, and others.

LIST OF REFERENCE SIGNS

1 pile
e1, e2, e3 measurement point

The invention claimed is:

1. A method for storing upgraded coal, the method comprising the steps of:
pulverizing low-grade coal;
mixing the pulverized low-grade coal with oil to produce a material slurry;
heating the material slurry to produce a dehydrated slurry;
separating the dehydrated slurry into oil and an upgraded coal;
molding the upgraded coal into upgraded coal briquettes;
pulverizing the molded briquettes of upgraded coal to provide a pulverized upgraded coal,
piling a particulate coal containing the upgraded coal, the particulate coal containing particles each having a particle diameter of 10 mm or less in an amount of 50 mass % or more, wherein at least a portion of the particulate coal is the pulverized upgraded coal.

2. The method for storing upgraded coal according to claim 1, wherein the particulate coal contains particles each having a particle diameter of 1 mm or less in an amount of 25 mass % or more, and particles each having a particle diameter of 0.15 mm or less in an amount of 7 mass % or more.

3. The method for storing upgraded coal according to claim 1, wherein the particulate coal contains particles each having a particle diameter of 10 mm or less in an amount of 90 mass % or less.

4. A method for storing upgraded coal, the method comprising the steps of:
pulverizing low-grade coal,
mixing the pulverized low-grade coal with oil to produce a material slurry,
heating the material slurry to produce a dehydrated slurry,
separating the dehydrated slurry into oil and an upgraded coal,
molding the upgraded coal into upgraded coal briquettes,
pulverizing the molded briquettes of upgraded coal to provide pulverized upgraded coal,
piling a particulate coal containing the upgraded coal, the particulate coal containing particles each having a particle diameter of 10 mm or less in an amount of 50 mass % or more, wherein at least a portion of the particulate coal is the pulverized upgraded coal and a portion is the briquettes of upgraded coal.

* * * * *